US007970520B2

(12) United States Patent
Gross

(10) Patent No.: US 7,970,520 B2
(45) Date of Patent: Jun. 28, 2011

(54) SYSTEM ARRANGEMENT OF A LIFTING DEVICE, IN PARTICULAR FOR A CONTAINER CRANE FOR THE LIFTING OF LOADS AND MOVING FOR THE OPERATION OF THE SYSTEM ARRANGEMENT

(75) Inventor: Rahim Gross, Hilden (DE)

(73) Assignee: M.A.T. Malmedie Antriebstechnik GmbH, Solingen (DE)

( * ) Notice: Subject to any disclaimer, the term of this patent is extended or adjusted under 35 U.S.C. 154(b) by 1069 days.

(21) Appl. No.: 11/791,580

(22) PCT Filed: Nov. 25, 2005

(86) PCT No.: PCT/DE2005/002134

§ 371 (c)(1),
(2), (4) Date: May 24, 2007

(87) PCT Pub. No.: WO2006/056193

PCT Pub. Date: Jun. 1, 2006

(65) Prior Publication Data

US 2008/0140289 A1 Jun. 12, 2008

(30) Foreign Application Priority Data

Nov. 25, 2004 (DE) ..... 10 2004 057 039
Dec. 24, 2004 (DE) ..... 10 2004 062 515
Jun. 13, 2005 (DE) ..... 10 2005 027 337

(51) Int. Cl.
*B66D 1/58* (2006.01)
*B66C 23/90* (2006.01)

(52) U.S. Cl. ..... 701/50; 212/272; 212/274; 212/278

(58) Field of Classification Search ..... 701/50; 212/278, 272, 273, 274, 275, 276, 277
See application file for complete search history.

(56) References Cited

U.S. PATENT DOCUMENTS 3,823,395 A * 7/1974 Rigney et al. ..... 340/531
(Continued)

FOREIGN PATENT DOCUMENTS

DE 884 233 C 7/1953
(Continued)

OTHER PUBLICATIONS

International Search Report.

(Continued)

*Primary Examiner* — Thomas G Black
*Assistant Examiner* — Wae Louie
(74) *Attorney, Agent, or Firm* — Collard & Roe, P.C.

(57) ABSTRACT

The lifting gear comprises two motors (1, 1') that are connected to a transmission (6) via respective drive shafts (2, 2'), couplings (3, 3'), with fitted brake disks (4, 4') or brake drums, brakes (14, 14') and transmission input shafts (5, 5'). The transmission (6) drives cable drums (9, 9') via transmission output shafts (7, 7') and couplings (8, 8'). The cable drums have a cable pull (12, 12') and fitted brake disks (10, 10') or brake drums and safety brakes (11, 11'). The inventive lifting gear is characterized by comprising, in the drive shafts (2, 2'), devices (13, 13') that completely or partially disconnect the motors (1, 1') from the transmission (6) when an excess load exceeds the predetermined load. They are monitored on both sides of the devices (13, 13') and the brakes (14, 14') and/or safety brakes (11, 11') are activated in the event of disconnection.

17 Claims, 2 Drawing Sheets

U.S. PATENT DOCUMENTS

Figure 1:
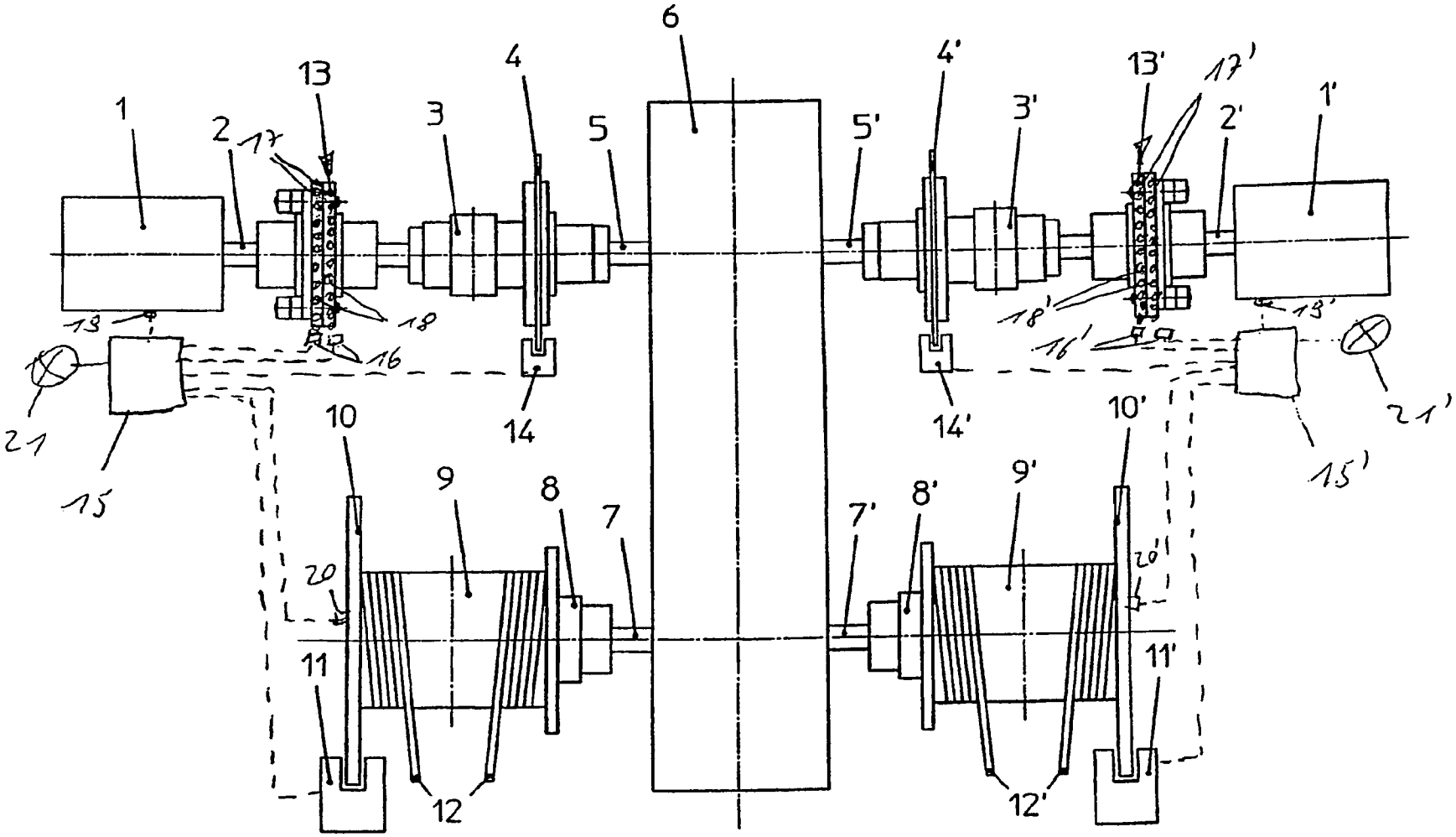

| | | | | |
|---|---|---|---|---|
| 4,003,482 | A * | 1/1977 | Cheze | 212/278 |
| 4,350,254 | A * | 9/1982 | Noly | 212/279 |
| 4,580,378 | A * | 4/1986 | Kelly et al. | 52/125.5 |
| 4,753,357 | A * | 6/1988 | Miyoshi et al. | 212/286 |
| 4,762,485 | A * | 8/1988 | Kanzaki | 425/434 |
| 5,058,752 | A * | 10/1991 | Wacht et al. | 212/278 |
| 6,073,496 | A * | 6/2000 | Kuhn et al. | 73/862.56 |
| 6,145,680 | A * | 11/2000 | Jussila et al. | 212/274 |
| 6,250,486 | B1 * | 6/2001 | Enoki | 212/322 |
| 6,382,437 | B1 * | 5/2002 | Okada et al. | 212/274 |
| 6,631,816 | B1 * | 10/2003 | Miyazawa et al. | 212/272 |
| 6,870,319 | B2 * | 3/2005 | Kayano et al. | 315/82 |
| 7,032,943 | B1 * | 4/2006 | Marler | 294/82.31 |
| 7,040,496 | B2 * | 5/2006 | Hakala | 212/274 |
| 7,206,662 | B2 * | 4/2007 | Sparenborg et al. | 700/213 |
| 7,366,338 | B2 * | 4/2008 | Jones et al. | 382/135 |
| 2008/0140289 | A1 * | 6/2008 | Gross | 701/50 |

FOREIGN PATENT DOCUMENTS

| | | | |
|---|---|---|---|
| EP | 0 678 473 | A | 10/1995 |
| GB | 30215 | A | 10/1911 |

OTHER PUBLICATIONS

International Preliminary Report on Patentability.

* cited by examiner

SYSTEM ARRANGEMENT OF A LIFTING DEVICE, IN PARTICULAR FOR A CONTAINER CRANE FOR THE LIFTING OF LOADS AND MOVING FOR THE OPERATION OF THE SYSTEM ARRANGEMENT

CROSS REFERENCE TO RELATED APPLICATIONS

Applicant claims priority under 35 U.S.C. §119 of German Application No. 10 2004 057 039.6 filed Nov. 25, 2004, German Application No. 10 2004 062 515.8 filed Dec. 24, 2004, and German Application No. 10 2005 027 337.8 filed Jun. 13, 2005. Applicant also claims priority under 35 U.S.C. §365 of PCT/DE2005/002134 filed Nov. 25, 2005. The international application under PCT article 21(2) was not published in English.

The invention refers to the system arrangement of structural components and groups in lifting devices of container cranes and a procedure for the operation of the system arrangement.

Typical lifting devices consist of the following components: motor, motor shaft, clutch, if necessary with incorporated brake disk or brake drum, brake, transmission input shaft, transmission, transmission output shaft, clutch, wire rope drum with wire rope and incorporated brake disk or brake drum with safety brake. This arrangement can be effected in a unilateral or multilateral transmission or in a combination of several transmissions.

Lifting devices of this type are, according to the present state of the art, not sufficiently secured against overloading. In particular, when the load to be lifted is jammed, a considerable overloading may occur. In this connection, it may even happen that the load lifted by the drive performance is temporarily exceeded, if in the event of jamming the motor or motors with high revolution have saved a lot of rotation energy through their own momentum.

The current state of the art are systems which induce a reduction of the drive performance of the motor by means of measuring the power and the tension of the torsion. However, it is also in this case the period of time, which is required from the registration of the fact until the actual reduction of the performance that creates an enormous excess load.

In exceptional cases, specific systems are carried out to achieve the avoidance of critical operational conditions, whose cause is an overloading. This avoidance is achieved by means of hydraulic and/or pneumatic yielding systems with the application of deflection rollers in the wire ropes. Furthermore, measuring processes can be carried out on an electronic basis (e.g. torque, rotational speed, etc.) at various power transmission shafts and evaluated via a corresponding control arrangement.

These systems lead in a critical load case to the initiation of braking procedures and the cutting off of the motor.

The major disadvantages are caused, on one hand, by the excessive expenses involved, which result from the extensive hydraulic systems or extensive electronic controls required, on the other hand will the non-decoupling of the motor and transmission or their flyweights respectively lead to the fact that in the course of the braking-down process considerably larger load peaks will result than the maximum permissible ones will admit.

It is the task of the invention under discussion that an arrangement of the type mentioned above is developed in such a way that the safety of a movement is additionally increased. Furthermore, a procedure for the operation of the arrangement is to be created.

This task is solved by the invention according to the claims 1 and 10 and their pertaining sub-claims and is represented in the drawing at an example in the form of a two-sided transmission.

The invention allows several forms of execution. For the further illustration, two of them have been presented in the drawing, and they are described in the following.

Figure 2:
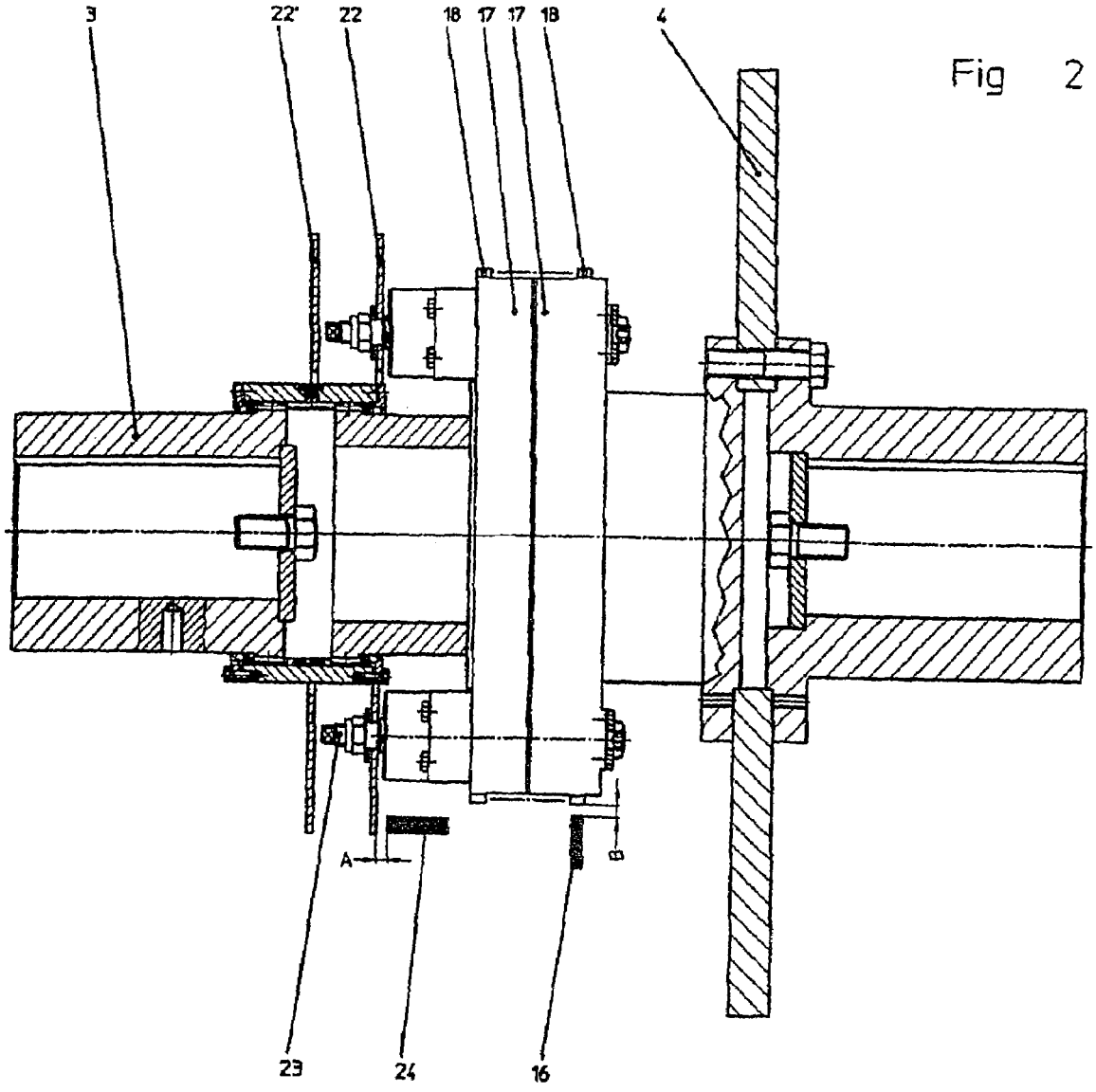

In FIG. 1, a system arrangement according to the invention is shown with a first variation for the switching of the device;

In FIG. 2, a partial section of the system arrangement according to the invention from FIG. 1 is shown, with a second variation for the switching of the device.

A lifting device illustrated in the FIGS. 1 and 2 is equipped with two motors 1, 1', each of which is connected with a transmission 6 via driving shafts 2, 2', clutches 3, 3' with brake disks 4, 4' attached or brake drums 4, 4' attached, brakes 14, 14' and via transmission input shafts 5, 5'. The transmission 6 drives rope drums 9, 9' via transmission output shafts 7, 7' and clutches 8, 8'. The rope drums are equipped with a rope 12, 12' with brake disks 10, 10' attached or brake drums and safety brakes 11, 11'. According to the invention, the lifting device is equipped in the driving shafts 2, 2' with devices 13, 13' which will separate the connection between the motors 1, 1' and the rope drums 9, 9' completely or partly in the case of excessive loads exceeding the permissible load. This will prevent a complete or partial destruction of the drive on account of an excessive load. By means of the separation of the motors 1, 1' from the rope drums 9, 9' through the devices 13, 13', some or all brakes 11, 11', 14, 14' are activated, on account of which fact the load to be lifted is held in a suspended position. On account of the separation of the motors 1, 1' from the transmission 6, there is also the consequence that the introduction of kinetic residual energy after the switch off of the motors 1, 1' into the rope drums 9, 9' is prevented. In additional forms of execution, which are however not displayed, the device 13, 13' can be arranged also within the transmission 6 or prior to the rope drums 9, 9'.

Furthermore, the lifting device is equipped with two control units 15, 15' for the steering of the brakes 11, 11', 14, 14'. For the recognition of the switching of the device 13, 13' the following two variations are preferably employed:

A first variation is displayed in FIG. 1:

The control units 15, 15' are connected on both sides of the motion sensors 16, 16', of the devices 13, 13' arranged as clutches. The devices 13, 13' show coupling disks 17, 17' in an arrangement opposed to each other, with teeth 18, 18' on their circumference. The motion sensors 16, 16' count the passing of the teeth 18, 18' of the coupling disks 17, 17'. The control units 15, 15' compare the number of the passing teeth 18, 18' in the course of a defined period of time and determine from the result the movements of the coupling disks 17, 17'. In the case of an involuntary difference between the movements of the coupling disks 17, 17', the control unit controls a part of or all brakes 11, 11', 14, 14', as a consequence of which these stop the rope drums 9, 9'. The movement sensors 16, 16' are preferably designed as approximation switches.

A variation of the device 13 illustrated in FIG. 2 shows how the control units 15, 15' are connected with the motion sensors 24 arranged on the motor-side half of the devices 13, 13' designed as a clutch. The devices 13, 13' show on the motor side axially arranged bolts 23, which again are connected either firm 22 or loose 22' with a disk 22. The motion sensors 24 detect in the case of a switching process of the device 13, 13' the axial movement of the bolts 23 and the disk 22, 22' and pass on the signal to the control unit. The control unit controls a part of or all brakes 11, 11', 14, 14', in which case the rope drums 9, 9' stop. The motion sensors 24 are preferably arranged as approximation switches.

The control units of both variations are, furthermore, connected with speed sensors 19, 19', 20, 20' of the motors 1, 1' and the rope drums 9, 9'. It is possible, in this way, to test the brakes 11, 11', 14, 14' one after the other, prior to the operation of the lifting device, by having the control units 15, 15' control initially the brakes 11, 1', 14, 14', on account of which the movement of the corresponding brake disks 4, 4', 10, 10' will be blocked. Subsequently, the motor 1, 1' will be started and the speed of the brake drums 9, 9' and, if required, the speed of the motors 1, 1' are determined. When, for instance, the speed sensors 20, 20' determine a movement of the rope drum 9, 9' beyond the normal speed—in spite of tightened brakes 11, 11', 14, 14'—the braking performance for a safe operation of the lifting device will not be sufficient. In such a case, the display unit 21, 21' will be activated for the operator of the lifting device, and a new start of the lifting device will be prevented or, exclusively, an emergency operation of the lifting device will be made possible.

The arrangement of the system arrangement according to claim 3 offers the advantage that the movement sensors have been arranged in such a manner that they will detect an actuation of the device (13) and pass on a signal to the control unit (15).

Of great advantage is the execution according to claim 2, in which case the separation is not again automatically created. In this way it is made impossible that the operator of the installation will again take up the operation of the units to be protected without visual inspection and examination.

Claim 7 designs the unit as a slip friction clutch, which in this arrangement ideally meets the requirements of a partial cancelling of the connection between motor and rope drum, since it passes on a part of the power in the slip friction operation. Through the operation of a downstream load-side brake according to claim 6, the excess load case can here be taken back again, the slip friction clutch can again come into the adhesion friction condition, and the lifting device can immediately continue to be operated.

On account of the complete separation of motor and rope drum, it is possible to exclude any excess load by one hundred percent.

Of great advantage is the execution according to claim 10, in which case the operation brakes 14, 14' and the safety brakes 11, 11' belonging to the state of the art take up the load-side power, released from the unit 13. In this connection, the execution according to claim 12 is also of great advantage, since the excess motor performance is also reduced in the overload case.

A mechanical separation between motor and rope drum in the unit 13 has the advantage to work without any third-party energy on its own. Hydraulic solutions can, in contrast, achieve high performance densities, by means of small unit volume and sizes, and as a consequence the flywheel effect of the unit 13 can be held small. For the electronic processing of the unit 13 having started operation, also an electrical execution is of advantage, because it will accept a signal for separation in a direct way.

The integration of the monitoring system for the recognition of overload cases within the unit 13 is in particular of great advantage for the retrofitting of existing lifting devices. This execution will then not require any additional retrofitting processes of further systems at the existing lifting devices and can, as a consequence, act independently.

In many lifting devices, a control system according to the state of the art is incorporated for the monitoring of anomalies of speed of the individual ingoing and outgoing driving units (all units from motor 1, 1' until brake disk (10, 10'), in order to ensure the activation of the safety brakes 11, 11' in the case of a failure of one of the units. Such a failure may, for instance, be a break in the driving shafts 2, 2', 5, 5', 7, 7', of the clutches 3, 3', 8, 8' or in the gear 6. In the claim 10 the advantage of the unit 13 is made use of in a way that, in the case of a separation, the relation of the speeds of motor 1, 1' and driving shaft 2, 2' to the speeds of all units following the unit 13 will be changed. This change is automatically detected by the control system for the monitoring of speed anomalies and can, accordingly, be used for the introduction of braking processes according to claim 10.

The reduction of the driving performance of the motor during the occurrence of an overload is of great advantage because it represents, with the integration of the usual braking system 4, 14, 4', 14' between motor and rope drum, a compact and economic arrangement. It is the state of the art that such units are executed also direct with an integrated clutch.

The invention claimed is:

1. A system arrangement of a lifting device, in particular for a container crane for the lifting of loads, with a transmission and a motor, whose driving shaft is connected with a transmission input side, and a transmission output side is connected with a rope drum, wherein an installation is provided between motor and transmission, wherein in a case of an overload a connection between the motor and the rope drum is disconnectable via the installation, wherein the installation has disengageable bolts and wherein the bolts are connected with a disk.

2. The system arrangement according to claim 1, wherein the installation, responding to the overload, is formed as a clutch for the separation of the connection, without being capable to re-establish this connection automatically again.

3. The system arrangement according to claim 1, wherein seen from the side of the installation on the side of the motor and on the side of the rope drum each, a movement or rotation sensor is arranged and wherein a control unit is provided for the comparison of the movements.

4. The system arrangement of claim 1, wherein the control unit (15) preferably shows an approximation sensor for the detection of the axial movement of the disk moved by the disengaging bolts.

5. The system arrangement of claim 1, wherein clutch halves arranged opposite to each other of the installation show markings and that the movement sensors are equipped with a device for the scanning of the markings.

6. The system arrangement of claim 1, wherein the control unit is equipped with a means for the control of at least one brake.

7. The system arrangement of claim 1, wherein the installation reacting to the overload is either a slip friction clutch or a separation clutch.

8. The system arrangement of claim 1, wherein the installation reacting to the overload is a clutch of mechanical, hydraulic, electrical or electro-magnetic type or a combination of these types and arranged between motor and gear.

9. The system arrangement of claim 1, wherein the installation reacting to the overload is formed as a clutch for the complete or partial separation of the connection and for the automatic re-establishment of the connection or for the re-establishment of the connection by means of a control signal.

10. The system arrangement according to claim 1, wherein movements can be measured and compared with each other, and wherein in a case of a difference between the movements above a certain value at least one brake is controlled for blocking the rope drum and/or the transmission.

11. A system arrangement of a lifting device, in particular for a container crane for the lifting of loads, with a transmission and a motor, whose driving shaft is connected with a transmission input side, and a transmission output side is connected with a rope drum, wherein an installation is provided between motor and transmission, the installation being able to disconnect a connection between the motor and the rope drum and having disengageable bolts, and wherein a disk is situated immediately in front of or behind the bolts.

12. A method for operation of a system arrangement, the method comprising the steps of:

providing a system arrangement of a lifting device, the system arrangement comprising:

a transmission having an input shaft, an output shaft, and a gear;

a motor having a driving shaft connected with the input shaft of the transmission;

a rope drum connected with the output shaft of the transmission;

an installation between the motor and the transmission comprising disengageable bolts and a disk; and at least one brake;

disconnecting via the installation a connection between the motor and the rope drum in a case of an overload;

measuring first movements of at least one of the motor and the driving shaft;

measuring second movements of at least one of the input shaft of the transmission, the output shaft of the transmission, and the transmission gear;

comparing the first movements to the second movements; and blocking at least one of the rope drum and the transmission via the at least one brake if a difference between the first movements and the second movements exceeds a first value.

13. The method according to claim 12, wherein the system arrangement further comprises an additional device, and wherein the installation disconnects to a sliding friction condition the connection between the motor and the rope drum in the case of an overload, and the method further comprising the step of:

reducing powers at the installation via the additional device until an adhesion friction condition is reached at the installation in the case of an overload.

14. The method according to claim 12, further comprising the step of:

reducing driving performance of the motor in the case of an overload.

15. The method according to claim 12, wherein the first movements measured are a first speed, and wherein the second movements measured are a second speed.

16. The method according to claim 12, wherein the disengageable bolts of the installation are connected with the disk of the installation.

17. The method according to claim 12, wherein the disk of the installation is situated immediately in front of or behind the disengageable bolts.

* * * * *

UNITED STATES PATENT AND TRADEMARK OFFICE

CERTIFICATE OF CORRECTION

PATENT NO. : 7,970,520 B2
APPLICATION NO. : 11/791580
DATED : June 28, 2011
INVENTOR(S) : Gross It is certified that error appears in the above-identified patent and that said Letters Patent is hereby corrected as shown below:

Column 4, line 41 (line 2 in Claim 4) after the word "unit", please delete: "(15)".

Signed and Sealed this
Ninth Day of August, 2011

David J. Kappos

David J. Kappos
*Director of the United States Patent and Trademark Office*